US006095849A

United States Patent [19]

Stekelenburg

[11] Patent Number: 6,095,849

[45] Date of Patent: Aug. 1, 2000

[54] STRUCTURE OF FLAT PLUG

[75] Inventor: Albert Stekelenburg, Taipei, Taiwan

[73] Assignee: All-Line Inc., Taipei, Taiwan

[21] Appl. No.: 09/172,049

[22] Filed: Oct. 14, 1998

[51] Int. Cl.[7] ..... H01R 13/62

[52] U.S. Cl. ..... 439/483; 439/160

[58] Field of Search ..... 439/483, 484, 439/160, 163, 159, 152, 372

[56] References Cited

U.S. PATENT DOCUMENTS 5,679,014 10/1997 Lan-Jen ..... 439/160

*Primary Examiner*—Steven L. Stephan
*Assistant Examiner*—Eugene G. Byrd
*Attorney, Agent, or Firm*—Dougherty & Troxell

[57] ABSTRACT

A flat electrical plug having push-up rod for prying loose the plug from an electrical outlet. The plug can be designed with an upper shell and a lower shell each has a recess to accommodate the push-up rod, which has a pair of pins as pivots. The lower shell and the upper shell have recesses and protrusions for securing the push-up rod while allowing the push-up rod to rotate freely about the pins. The push-up rod is pushed down when the plug is inserted in an outlet. When the push-up rod is pulled up from the rod head, the rod tail will exert a force against the outlet thereby prying loose the plug from the outlet.

4 Claims, 3 Drawing Sheets

STRUCTURE OF FLAT PLUG

FIELD OF THE INVENTION

The present invention relates to an electrical plug, especially to a plug with a flat surface, which can be easily unplugged from the outlet.

BACKGROUND OF THE INVENTION

The electrical plugs in prior art are mostly designed such that the cord and the prongs are in same direction. Such plugs are almost always easily hit by external objects and, therefore, they are easily shaken loose accidentally.

There are several electrical plugs which are designed to overcome the above-mentioned problems, such as those disclosed in U.S. Pat. Nos. 4,857,013, 5,567,181, 5,679,014. The common features of these prior art plugs are that the cord and the prong are in right angle to each other and the plug is made in a flat form. Furthermore, a drawing loop is provided on the outer surface of plug so that the plug can be pulled away from an outlet by applying a force to the drawing loop. However, the drawing loop is usually small in consideration of the small area allowed for each plug on a multiple-outlet. The drawing loop is easily damaged. It is desirable to provide an electric plug having a sturdy part for pulling the plug out of an outlet.

SUMMARY OF THE INVENTION

It is an objective of the present invention to provide a flat electrical plug having a sturdy part so that the plug can be easily unplugged from an outlet. It is another objective of the present invention to provide an electric plug having a push-up rod for prying loose the plug from an outlet while keeping the electric plug small and compact.

DETAILED DESCRIPTION OF THE PREFERRED EMBODIMENT

Figure 1:
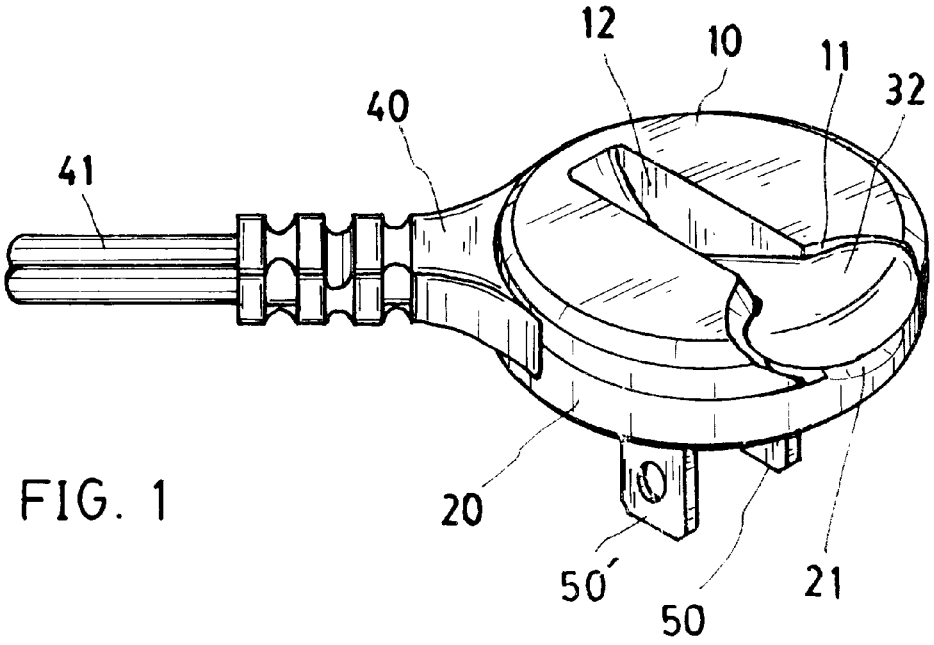
FIG. 1 is a perspective view of the electrical plug, according to the present invention.
Figure 2:
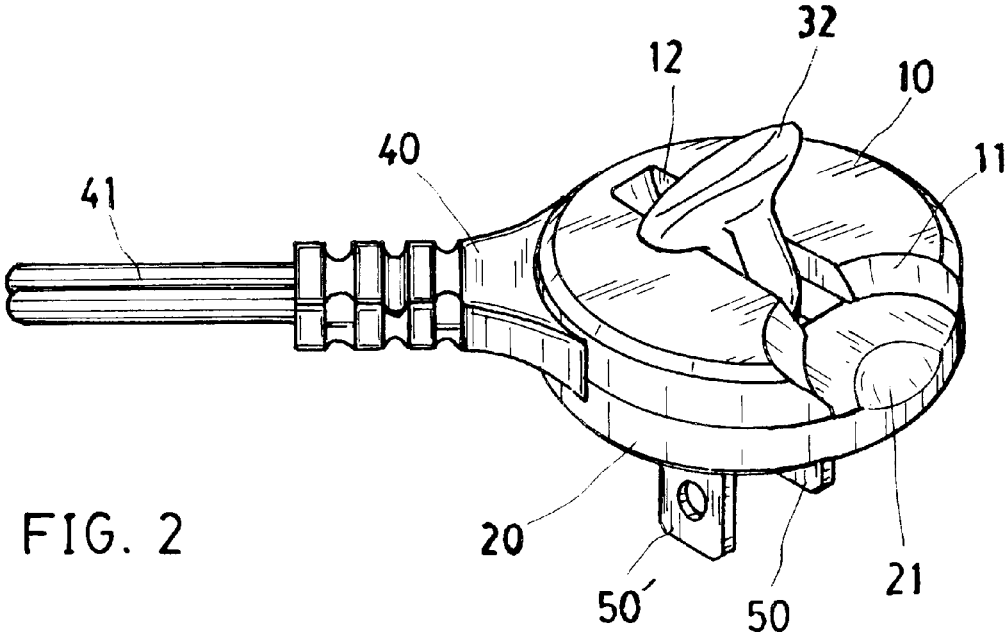
FIG. 2 is another perspective view of the electrical plug.
Figure 3:
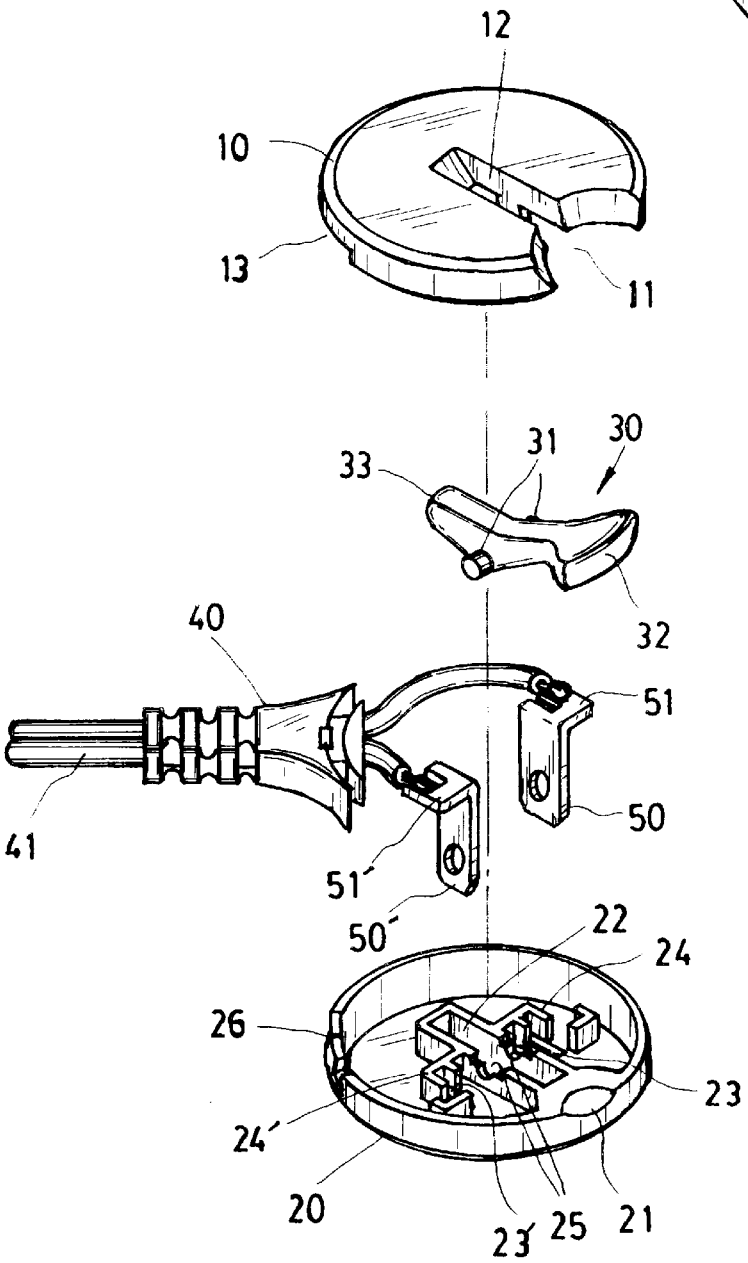
FIG. 3 is a exploded view of the electrical plug.

As shown in FIGS. 1–3, the present invention includes an upper shell 10, a lower shell 20, a push-up rod 30, an end part 40 for holding a cord 41, and two prongs 50 and 50'. The upper shell 10 is a hollow half-shell with an opening 11 being provided at its front portion. A recess 12 is provided from the direction of the opening 11 toward the center of the upper shell. Notch 13 is provided on a side edge of the upper shell 10 to receive the wires from the cord 41. The lower shell 20 is a hollow half-shell relative to the upper shell 10. A recess 21 is provided in corresponding to the recess 12 of the upper shell. Likewise, a recess 22 provided on the front portion the lower shell in corresponding to the opening 11. Within the lower shell, there are prong holes 23, 23' provided at two sides of the recess 22. The walls 24, 24' are provided at the outside of the prong holes 23, 23' and a pair of recesses 25 are provided about the recess 22. Notch 26 is are provided at a side edge of the lower shell 20, in corresponding to the notch 13 of the upper shell.

The push-up rod 30 is a structural body provided between the recess 12 and recess 22. The rod includes a pair of pins 31, a rod head 32 and a rod tail 33. The pins 31 properly fit in the recess 25 for pivoting. Preferably, the rod head is slightly large than the rod tail so that the rod head can be pulled up easily when the plug is unplugged from an outlet. Preferably, the rod tail 33 is in form of an arch.

The end part 40 is a structural body for holding the cord 41 where the cord is fixed at the notches 13 and 26. Preferably, the cord and the end part are integrated with the plug by means of the bayonet structure. The cord 41 passes through the end part 40 and is connected to a pair of fixing plates 51, 51' on prongs 50, 50'.

Figure 4:
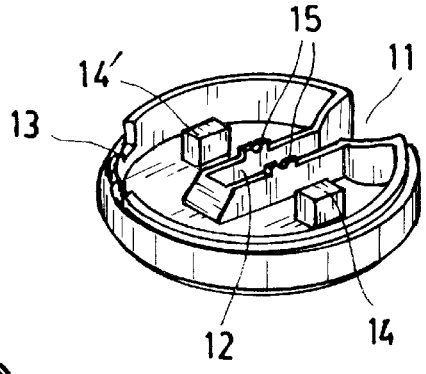
FIG. 4 is other perspective view of the upper shell of the electrical plug of the FIG. 3.

FIG. 4 is a perspective view of the upper shell 10 which is turned over 180 degree to show the details thereunder. As shown, protrusions 14 and 14' are provided on the two sides of the recess 12 on the inside of the upper shell 10. Also, a pair of protrusions 15 are provided about the recess 12 to receive the pins 31.

The prongs 50, 50' are designed to be inserted into the lower shell 20 through the prong holes 23, 23'. The fixing plate 51, 51' are properly clamped between the walls 24, 24 and the protrusions 14, 14'.

The pins 31 of the push-up rod 30 fit properly over the recesses 25 and are secured with the protrusions 15 so that the pins can rotate in the recesses 25. Preferably, a dent is provided on each of the protrusions 15.

The upper shell 10, the lower shell 20, the end part 40 and other parts of the plug can be made into an integral body by an adhesive. Similarly they are be fused into place using a microwave device or other heating devices to form a sturdy plug as shown in FIGS. 1 and 2.

When the electrical plug is inserted into an outlet, it is preferred that the push-up rod 30 is pushed downward, as shown in FIG. 1. When the plug is to be pulled out from an outlet, it is preferred that the push-up rod 30 is pulled upward, as shown in FIG. 2.

Figure 5:
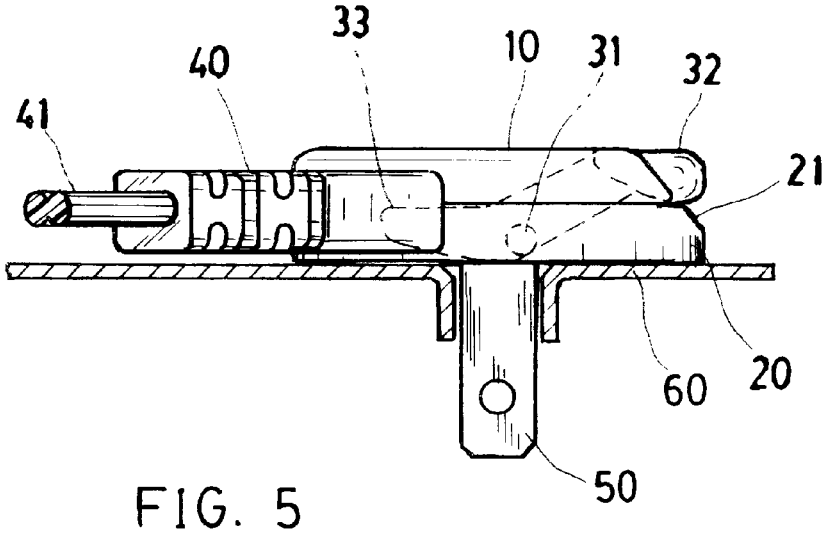
FIG. 5 is a schematic view of the action of the present invention.
Figure 6:
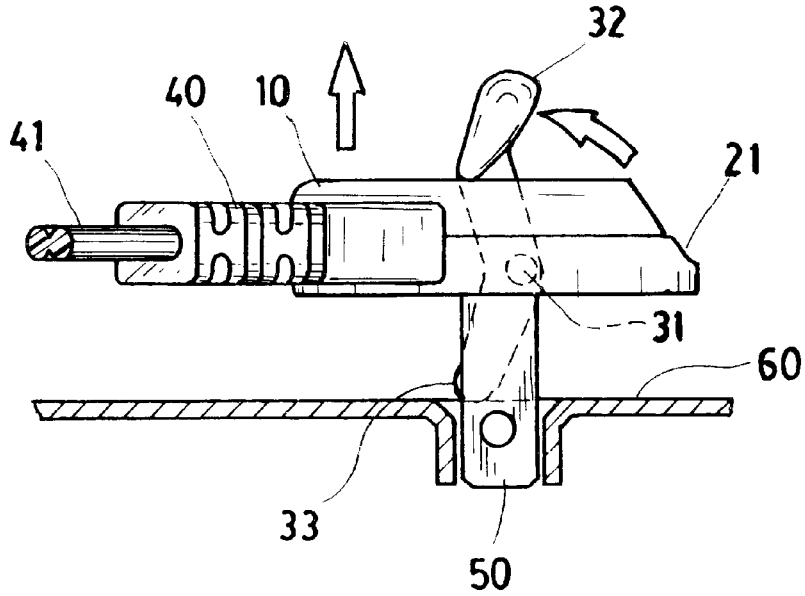
FIG. 6 is another schematic view of the action of the present invention.

FIGS. 5 and 6 are schematic views of the plug when the push-up rod 30 is pushed down and pulled upward, respectively. As shown in FIG. 5, the rod head 32 is located above the recess 21 of the lower shell while the rod tail 33 is hidden within the plug. But when the push-up rod is pulled upward, as shown in FIG. 6, the rod tail 33 is pushed against part of the outlet 60. Thus, the electrical plug is pried loose from the outlet by the action of the push-up rod 30.

According to the preferred embodiment of the present invention, as shown in FIGS. 1–6, a push-up rod 30 located between the prongs of the electrical plug and above in the middle section of an outlet is provided for prying loose the plug from the outlet. The recess 21 provided at the lower shell 20 below the rod head 32 so that the push-up rod can be easily pulled upward for the prying action.

There recess 21 of the lower shell 20 can also be a notch, in order to provide a larger space for the ease of pulling up the push-up rod 30.

In summary, the electrical plug, according to present invention, is comprised of:

- an upper shell having an opening and a recess provided inwards in the direction of the opening,
- a lower shell having a recess in corresponding to the recess in the upper shell;
- at least two electrically conducting prongs connecting an electric cord for conducting electricity and at least two prong holes for seating the two prongs, a push-up rod properly located within the recesses on the upper and lower shell, the push-up rod having a pair of pins as pivots;

a pair of third recesses on the lower shell to receive the pins;

a pair of protrusions provided on the upper shell to secure the pins so that the pins can be rotatably positioned between the upper shell and the lower shell;

wherein the push-up rod is pushed downward when the plug is inserted into the outlet and the push-up rod is pulled up to provide a prying action against the outlet.

For the ease of pulling up the push-rod, a notch or an opening is provided in the front portion of the lower shell forming a gap between the lower shell and the push-up rod.

It should be noted that the drawing figures are used for illustrative purposes only. For example, the plug shown in the drawings is that of a two-prong type. The same push-up rod can also be used on a three-prong type or other electrical plugs.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An electrical plug comprising:

an upper shell;

a lower shell mounted to the upper shell;

at least two spaced apart prongs extending outwardly from the lower shell to be inserted into an electrical outlet for receiving electricity;

an electric cord connected to the prongs; and a push-up rod pivotally secured by the upper shell and the lower shell, the push-up rod having a rod head and a rod tail, the rod tail located between the spaced apart prongs, the push-up rod being movable between a first position in which the rod head is located within a first recess in the upper shell and the rod tail is located in a second recess in the lower shell, and a second position in which the rod tail extends from the lower shell between the spaced apart prongs for prying the plug loose from an outlet, whereby the rod head and the rod tail are located within a periphery of the lower shell when the push-up rod is in the first position.

2. An electrical plug to be inserted into an electrical outlet to receive electricity, comprising:

an upper shell having an opening and a first recess extending inwardly from the opening;

a lower shell having a second recess corresponding to the first recess;

at least two electrically conducting spaced apart prongs connected to an electric cord for conducting electricity;

a push-up rod pivotally located within the first and second recesses, said push-up rod having a pair of pins;

a pair of third recesses on the lower shell receiving said pins;

a pair of protrusions provided on the upper shell receiving said pins so that said pins can be rotatably positioned between the upper shell and the lower shell;

the push-up rod having a rod head and a rod tail, the rod tail located between the spaced apart prongs, the push-up rod being movable between a first position in which the rod head is located within the opening in the upper shell and the rod tail is located in the second recess in the lower shell, and a second position in which the rod tail extends from the lower shell between the spaced apart prongs for prying the plug loose from an outlet, whereby the rod head and the rod tail are located within a periphery of the lower shell when the push-up rod is in the first position.

3. The electrical plug of claim 2 further comprising a notch in the lower shell forming a gap between the rod head of the push-up rod and the lower shell to facilitate pulling up the push-up rod.

4. The electrical plug of claim 1 further comprising an opening in the lower shell forming a gap between the rod head of the push-up rod and the lower shell to facilitate pulling up the push-up rod.

* * * * *